US006520217B2

(12) United States Patent
Zanatta

(10) Patent No.: US 6,520,217 B2
(45) Date of Patent: Feb. 18, 2003

(54) WEAVING MACHINE TRANSMISSION FOR THE CONTROL OF THE STROKE OF A SLEY SHAFT

(75) Inventor: Davide Zanatta, Vicenza (IT)

(73) Assignee: Sulzer Tessile Srl, Schio (IT)

( * ) Notice: Subject to any disclaimer, the term of this patent is extended or adjusted under 35 U.S.C. 154(b) by 0 days.

(21) Appl. No.: 09/940,688

(22) Filed: Aug. 27, 2001

(65) Prior Publication Data

US 2002/0069926 A1 Jun. 13, 2002

(30) Foreign Application Priority Data

Aug. 28, 2000 (EP) ..... 00810765

(51) Int. Cl.[7] ..... D03D 39/22
(52) U.S. Cl. ..... 139/26; 139/25
(58) Field of Search ..... 139/26, 25, 102, 139/27, 317

(56) References Cited

U.S. PATENT DOCUMENTS 3,920,052 A * 11/1975 Nelson ..... 139/102
4,294,290 A * 10/1981 Freisler ..... 139/102
5,058,628 A * 10/1991 Spiller et al. ..... 139/102
5,439,034 A * 8/1995 Corain et al. ..... 139/26
6,186,187 B1 * 2/2001 Nakada ..... 139/25

FOREIGN PATENT DOCUMENTS

EP 0 350 446 A 1/1990
FR 2 429 853 1/1980

* cited by examiner

*Primary Examiner*—John J. Calvert
*Assistant Examiner*—Robert H. Muromoto, Jr.
(74) *Attorney, Agent, or Firm*—Townsend and Townsend and Crew LLP

(57) ABSTRACT

The weaving machine transmission (1) for the control of the stroke of a sley shaft (8) comprises a roller lever (4) and a sley shaft (8) between which there is an active connection, with the roller lever (4) and the sley shaft (8) being arranged so as to be pivotal and mutually rotatable about a common axis (A), with a joint arrangement (6) forming the active connection between the roller lever (4) and the sley shaft (8) and with the joint arrangement (6) being designed such that the length of the active connection can be varied by means of an adjusting apparatus (13) which acts on the joint arrangement (6).

10 Claims, 3 Drawing Sheets

WEAVING MACHINE TRANSMISSION FOR THE CONTROL OF THE STROKE OF A SLEY SHAFT

BACKGROUND OF THE INVENTION

1. Field of the Invention

The invention relates to a weaving machine transmission.

2. Description of the Prior Art

A weaving machine transmission for a terry cloth weaving machine which permits a modulation of the weft beat-up position of the reed is known from the specification EP 350 446. This weaving machine transmission enables the beat-up movement of the reed to be modulated in such a manner that either a full beat-up or a partial beat-up is carried out. This modulation of the beat-up enables a terry cloth to be produced. Disadvantageous in the known weaving machine is that individual parts such as rollers or control curves are subjected to an extremely intensive alternating stress, which has a rapid wear of these components as a con-sequence.

SUMMARY OF THE INVENTION

The object of the present invention is to propose an economically more advantageous weaving machine transmission which is suitable in particular for use as a terry cloth transmission.

The object is satisfied in particular by a weaving machine transmission for the control of the stroke of a sley shaft, comprising a roller lever and a sley shaft between which there is an active connection, with the roller lever and the sley shaft being arranged so as to be pivotal and mutually rotatable about a common axis, with a joint arrangement forming the active connection between the roller lever and the sley shaft, and with the joint arrangement being designed such that the length of the active connection can be varied by means of an adjusting apparatus which acts on the joint arrangement.

A weaving machine usually has a main drive shaft and a plurality of cam or eccenter packages which are arranged on it. The weaving machine transmission in accordance with the invention comprises a roller lever with two rollers, with the rollers rolling along the eccenter package so that the roller lever continually executes a pivotal movement. A sley is also firmly connected to the sley shaft. The weaving machine transmission in accordance with the present invention permits the sley shaft, or the position of the sley with respect to the position of the roller lever, to be pivoted. Through this the final position or the reversal point of the sley respectively is in particular adjustable, so that either a full beat-up or a partial beat-up is possible with the sley. The joint arrangement in accordance with the invention forms an active connection between the roller lever and the sley shaft. The joint arrangement is for example designed as a toggle lever. The weaving machine transmission in accordance with the present invention has the advantage that a lower stress arises, which has a lower wear as a consequence. The joint arrangement, which forms the active connection between the roller lever and the sley shaft, is subject to a lower loading and therefore a very low wear, in particular also because the joint arrangement has no components which roll or slide along one another. An adjusting apparatus which acts on the joint arrangement permits the centre of gravity for the joint arrangement to be actuated and thereby the angle between the roller lever and the sley shaft to be adjusted. The adjusting apparatus is preferably designed such that it is possible to modulate the beat-up location of successive movements of the sley, preferably in such a manner that each beat-up location can be set individually and independently of the previous beat-up location. This enables a modulation of the beat-up location of the sley for individual wefts.

In a preferred embodiment the toggle lever is arranged in the joint arrangement in such a manner that the latter is located in an extended position extending in a straight line at least in a full beat-up of the sley, so that the torque which is to be transmitted from the roller lever to the sley can be transmitted ideally, in particular without loss and without a spring action arising. Through this geometrical embodiment the stress during the full beat-up is considerably reduced. The roller lever and the sley shaft are pivotally journalled about a common axis. In an advantageous embodiment the roller lever with its rollers and further components which might be required is designed in such a manner that it has a mass distribution which is substantially symmetrical with respect to the common axis.

DETAILED DESCRIPTION OF PREFERRED EXEMPLARY EMBODIMENTS

Figure 1A:
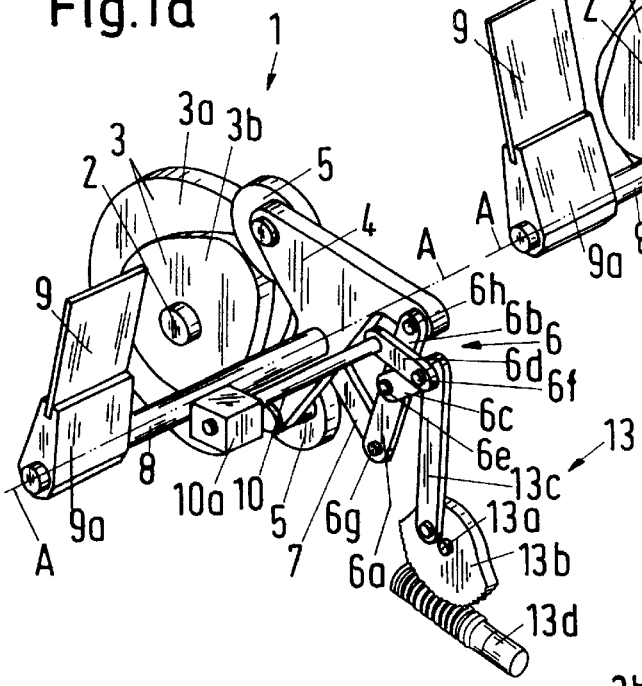
FIG. 1*a* is a perspective illustration of the drive apparatus with the position of the sley in a beat-up position.

The perspective illustration in accordance with FIG. 1*a* shows the main drive shaft 2 of a weaving machine at which an eccenter package 3 comprising a first eccenter 3*a* and a second eccenter 3*b* is arranged. The two rollers 5 roll off on or along the surface of the first and second eccenter 3*a*, 3*b*, with the rollers 5 being rotatably connected to the roller lever 4. This causes a pivotal movement of the roller lever 4, which is rotatably journalled about the axis of rotation A. The drive apparatus 1 comprises the roller lever 4, the sley shaft 8 and the joint arrangement 6. The roller lever 4 and the sley shaft 8 are arranged to be pivotal and mutually rotatable about a common axis of rotation A. The connector part 7 is firmly connected to the sley shaft 8. A sley 9 is firmly connected via a connector part 9*a* to the sley shaft 8. The joint arrangement 6 comprises a first arm 6*a* and a second arm 6*b* which are mutually pivotally connected to one another via a first pivotal connection point 6*e* and form a toggle lever in this manner. At the end section lying opposite to the first pivotal connection point 6*e* the first arm 6*a* is rotatably connected to the connector part 7 via a third pivotal connection point 6*g*, whereas the second arm 6*b* is rotatably connected via a fourth pivotal connection point 6*h* to the roller lever 4. The relative angle between the roller lever 4 and the sley shaft 8 is dependent on the position of the cranked lever which is formed by the first arm 6*a* and the second arm 6*b*. When the toggle lever is extended the roller lever 4 and the connector part 7 or, respectively, the sley shaft 8 or the sley 9 have the greatest possible mutual angle of rotation. If the toggle lever is angled, then the mutual angle of the roller lever 4 and the connector part 7 is thereby reduced.

Figure 5:
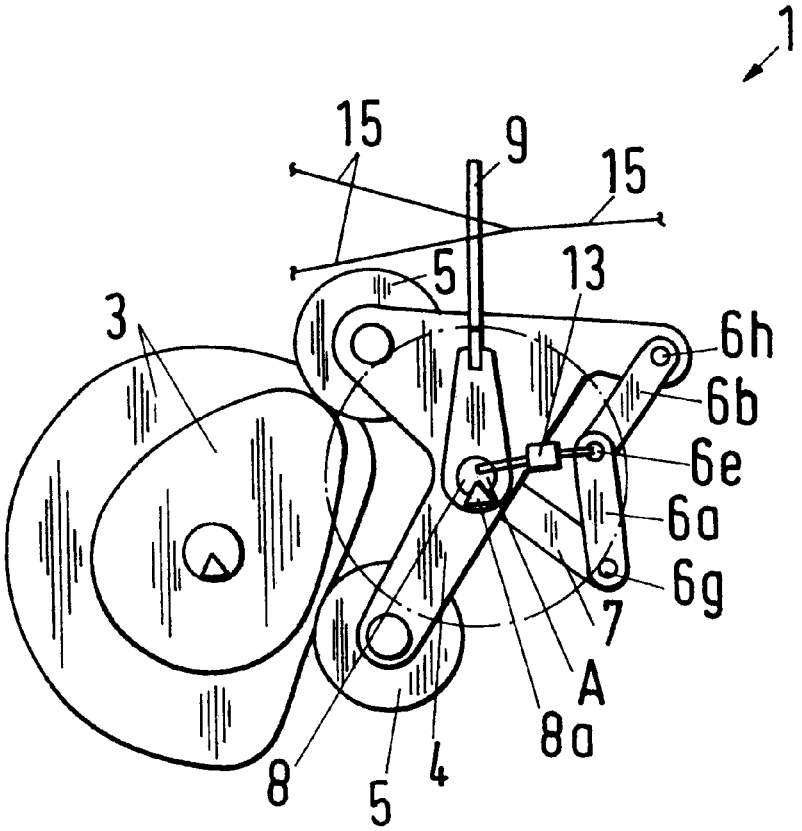
FIG. 5 shows a further exemplary embodiment of a weaving machine transmission with a linearly driven adjusting apparatus.

FIG. 5 shows in a side view the drive apparatus 1, with the roller lever 4 and the sley 9 being rotatably journalled about a common axis A which is formed by the sley shaft 8. The sley shaft 8 is journalled in a fixed portion via a bearing 8*a*. A linearly movable adjusting apparatus 13 is coupled with its one end to the sley shaft 8 and with its other end to the first pivotal connection point 6*e*. Through a length adjustment of the adjusting apparatus 13 the mutual angle of the first and second arms 6*a*, 6*b* can thus be adjusted, through which the mutual angle of the roller lever 4 and sley shaft 8 or the sley 9 is adjustable. This arrangement has no mutually sliding or rolling components, so that the drive apparatus 1 in accordance with the invention comprising a joint arrangement 6 between the roller lever 4 and the sley shaft 8 has a very low wear and can therefore be operated reliably in the long term, with low maintenance and economically. The joint arrangement 6 and the adjusting apparatus 13 which co-operates with it can be designed in the most diverse manners in order to effect an adjustable mutual rotation between the roller lever 4 and the sley shaft 8.

Figure 2A:
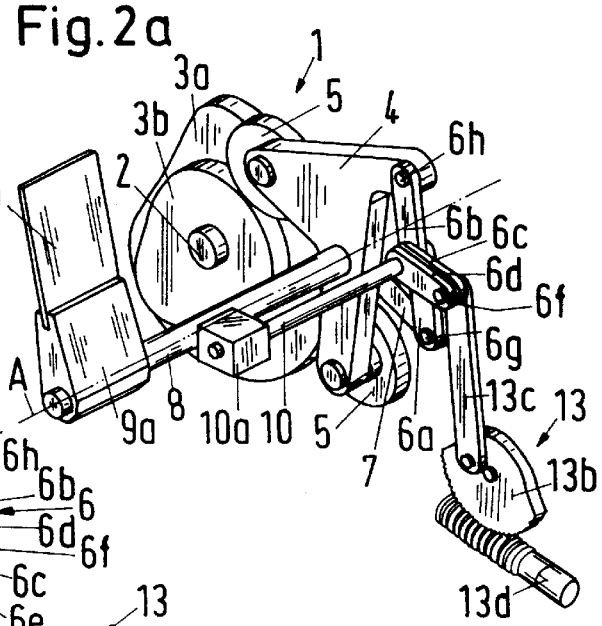
FIG. 2*a* is a perspective illustration of the drive apparatus with the position of the sley in the maximum open position.
Figure 1B:
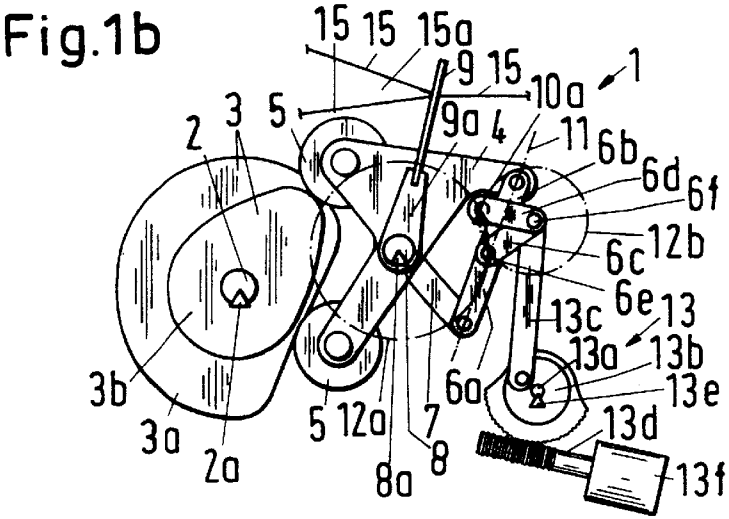
FIG. 1*b* is a side view of the drive apparatus which is illustrated in FIG. 1*a;*
Figure 2B:
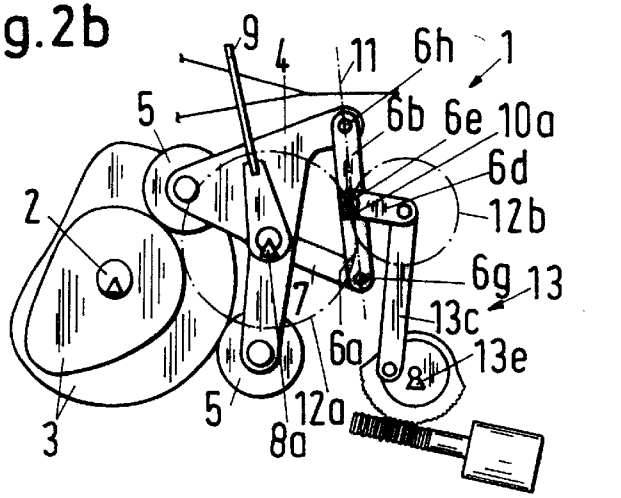
FIG. 2*b* shows a side view of the drive apparatus which is illustrated in FIG. 2*a;*

In the remaining FIGS. 1*a* to 4*b* a further exemplary embodiment of a weaving machine transmission 1 with a joint arrangement 6 and an adjusting apparatus 13 is illustrated in different setting positions. The joint arrangement 6 which is illustrated in perspective in FIG. 1*a* comprises in addition to the first and second arms 6*a*, 6*b* a third arm 6*c* as well as a fourth arm 6*d*, with the third and fourth arms 6*c*, 6*d* being mutually pivotally connected via a second pivotal connection point 6*f*. At the end section which lies opposite to the second pivotal connection point 6*f* the third arm 6*c* is pivotally connected to the first pivotal connection point 6*e*. At the end section lying opposite to the second pivotal connection point 6*f* the fourth arm 6*d* is firmly connected to a shaft 10, with the shaft 10 being rotatably journalled in a bearing 10*a* of fixed position. An adjusting apparatus 13 comprises a journalled shaft 13*a*, on which a gearing part 13*b* is rotatably journalled. The gearing part 13*b* is coupled via a toothed arrangement to a worm drive 13*d*, so that the pivotal position of the gearing part 13*b* can be adjusted by a rotation at the worm drive 13*d*. A connection part 13*c* is eccentrically displaced and rotatably arranged with respect to the shaft 13*a*, so that the position of the connection part 13*c* is adjustable. FIG. 1*b* shows the arrangement in accordance with FIG. 1*a* in a side view, with identical components being provided with identical reference symbols. The main shaft 2, the sley shaft 8, and the shaft 10 as well as the shaft 13*a* are rotatably journalled in a fixed position via respective bearings 2*a*, 8*a*, 10*a*, 13*e* of a fixed position. The connection part 13*c* is displaceably journalled in the adjusting apparatus 13. The fourth lever 6*d* is rotatably journalled at the firmly arranged shaft 10, so that the position of the second pivotal connection point 6*f*, which rotatably connects the fourth arm 6*d* and the connection part 13*c*, is adjustable depending of the position of the connection part 13*c*. The location of the second pivotal connection point 6*f* however forms the reference for the movement of the third arm 6*c*, which is rotatably connected on the one hand to the second pivotal connection point 6*f* and is pivotally connected on the other hand to the first and second arms 6*a*, 6*b* at the first pivotal connection point 6*e*. The circle 12*b*, which extends concentrically to the second pivotal connection point 6*f*, represents the geometrical locus of all points along which the first pivotal connection point 6*e* could move if the third arm 6*c* were not coupled to the first and second arm 6*a*, 6*b*. The circle 12*a*, which extends concentrically to the sley shaft 8, represents the geometrical locus of all points which the first pivotal connection point 6*e* could assume if the third arm 6*c* were not present and the roller lever 4 and the sley shaft 8 rotate about their own axis A. FIG. 1*a* and FIG. 1*b* show the sley 9 in the position of a full beat-up, whereas FIGS. 2*a* and 2*b* show the sley 9 in the rear reversal position. The different positions of the sley 9 in FIGS. 1*a*, 2*a* and 1*b*, 2*b* is caused only by the rotation of the main drive shaft 2, which moves the new position via the eccenter package 3, the rollers 5, the roller lever 4 and the joint arrangement 6 as well as the sley shaft 8. In this the adjusting apparatus 13 was not actuated. In the movement which takes place between the state which is illustrated in FIGS. 1 and 2 the first pivotal connection point 6*e* is moved along the concentric circle 12*b*. FIGS. 1*b*, 2*b* show the toggle lever comprising the first arm 6*a* and the second arm 6*b* in each case in an extended position, so that the first pivotal connection point 6*e*, the third pivotal connection point 6*g* and the fourth pivotal connection point 6*h* are arranged to lie on a common straight line 11. In FIGS. 1*b*, 2*b* the drive apparatus 1, or the joint arrangement 6 is designed in such a manner that the first pivotal connection point 6*e* is located on the intersection of the concentric circles 12*a*, 12*b* in both positions, which has the result that the toggle lever joint comprising the first arm 6*a* and the second arm 6*b* is in an extended position. During the movement of the cranked lever from the extreme position which is illustrated in FIG. 1*b* to the extreme position which is illustrated in FIG. 2*b* the toggle lever experiences a slight bending. The arrangement which is illustrated in FIG. 1*b* and 2*b* has the advantage that the cranked lever is in an extended position in the extreme positions which are illustrated in FIGS. 1*b* and 2*b*, so that a large force or a large torque can be transmitted between the roller lever 4 and the connector part 7, with in addition no or only a very low wear of the joint arrangement 6 arising.

Figure 3A:
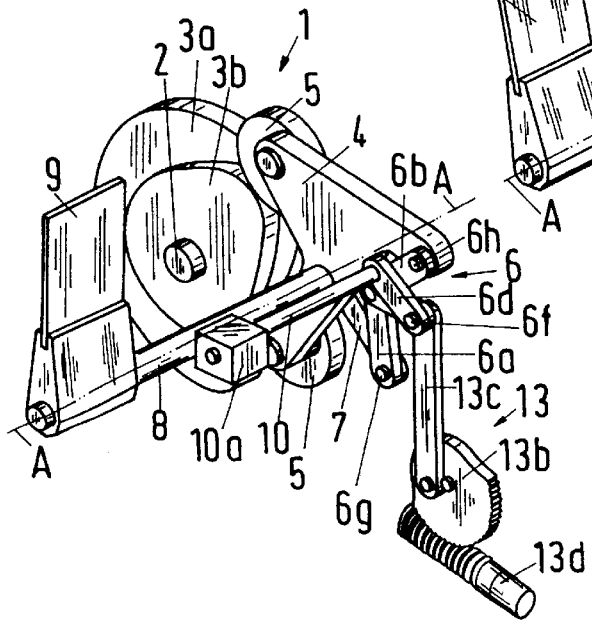
FIG. 3*a* shows a perspective illustration of the drive apparatus in a partial beat-up.
Figure 4A:
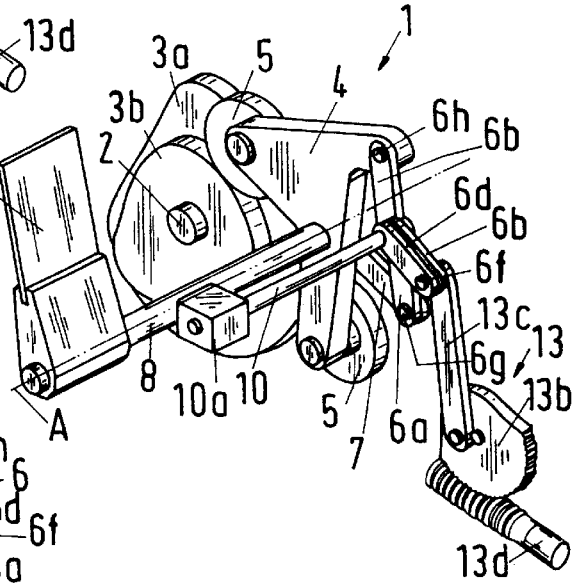
FIG. 4*a* is a perspective illustration of the drive apparatus with the position of the sley in the maximum open position.
Figure 3B:
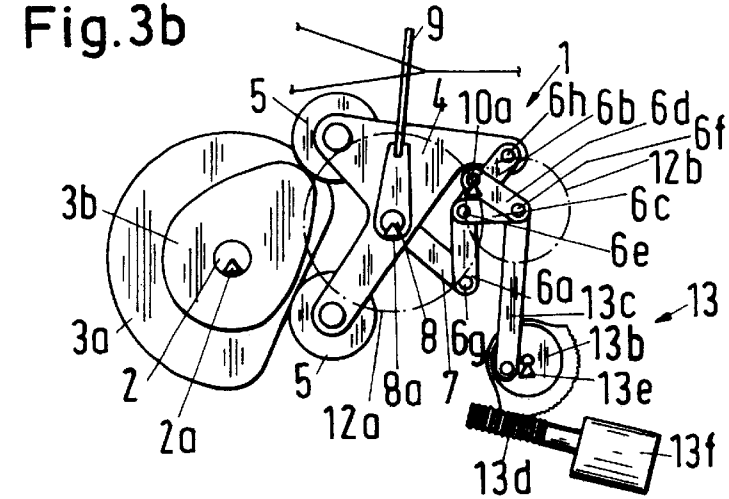
FIG. 3*b* shows a side view of the drive apparatus which is illustrated in FIG. 3*a;*
Figure 4B:
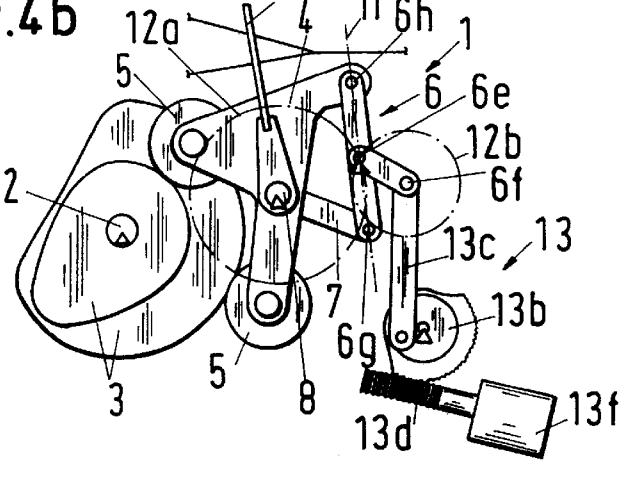
FIG. 4*b* shows a side view of the drive apparatus which is illustrated in FIG. 4*a;*

The eccenter package 3 and the roller lever 4 are located in the same position in the drive apparatus 1 which is illustrated in FIGS. 1*a*, 1*b* and in the drive apparatus 1 which is illustrated in FIGS. 3*a*, 3*b*. The arrangement of these figures differs however in that the adjusting apparatus 13 was pivoted through an actuation of the worm drive 13*d* with motor 13*f*, so that the connection part 13*c* was shifted substantially downwardly, which has the result that the second pivotal connection point 6*f* was also shifted downwardly. Since the fourth arm 6*d* is stationarily journalled at the bearing 10*a* at its one end section, this has the result that the cranked lever comprising the first arm 6*a* and the second arm 6*b* adopts an angle through which the final position of the sley 9 is displaced to the left, as a comparison between FIGS. 1*b* and 3*b* shows. FIG. 3*b* shows the final abutment position of the sley 9, with the sley 9 executing a partial beat-up. Through the rotating of the main drive shaft 2 the sley 9 is continually moved between a maximum opening position and the illustrated beat-up position. This beat-up position causes a so-called partial beat-up, which is required for the production of a terry cloth. FIGS. 4*a* and 4*b* show the arrangement which is illustrated in FIGS. 3*a*, 3*b* with the sley 9 open to a maximum. The shaft 10 in the view which is illustrated in FIG. 4*b* is located exactly at the intersection of the concentric circles 12*a*, 12*b*, which has the result that the first pivotal connection point 6*e* in the position which is illustrated in FIG. 4*b* likewise comes to lie at the intersection of the concentric circles 12*a*, 12*b*, which again has the result that the toggle lever joint comprising the first and second arm 6*a*, 6*b* is extended, and the first pivotal connection point 6*e*, the third pivotal connection point 6*g* and the fourth pivotal connection point 6*h* lie on a common straight line.

What is claimed is:

1. A weaving machine transmission for the control of the stroke of a sley shaft, the transmission comprising a roller lever and a sley shaft between which there is an active connection, wherein the roller lever and the sley shaft are arranged such that they are pivotal and mutually rotatable about a common axis, wherein a joint arrangement forms the active connection between the roller lever and the sley shaft, and wherein the length of the active connection may be varied by means of an adjusting apparatus that acts on the joint arrangement.

2. A weaving machine transmission in accordance with claim 1 wherein the joint arrangement comprises a first and a second arm, wherein the first and the second arm are mutually pivotally connected to form a first pivotal connection point, wherein the first arm is pivotally connected via a third pivotal connection point to the sley shaft, and wherein the second arm is pivotally connected to the roller lever via a fourth pivotal connection point.

3. A weaving machine transmission in accordance with claim 2 wherein the adjusting apparatus is arranged to act upon at least one of the first and second arms in such a manner that the mutual angle between the first and second arm may be varied.

4. A weaving machine transmission in accordance with claim 2 wherein the adjusting apparatus acts directly on the first pivotal connection point.

5. A weaving machine transmission in accordance with claim 2 wherein the first and second arms are mutually matched and are pivotally arranged relative to one another in such a manner that they may assume a position in which the first, third and fourth pivotal connection points lay on a common straight line.

6. A weaving machine transmission in accordance with claim 5 wherein the third and fourth pivotal connection points are movable on a path that extends concentrically to the common axis, and wherein the first pivotal connection point is arranged to be movable in such a manner that the first, third and fourth pivotal connection points lay on a common straight line at least at a reversal point of the sley shaft.

7. A weaving machine transmission in accordance with claim 2 wherein the joint arrangement comprises the third and fourth arms that are mutually pivotally connected at a second pivotal connection point, wherein the adjusting apparatus acts directly on a second pivotal connection point, wherein the third arm is pivotally connected to the first pivotal connection point, and wherein the fourth arm is pivotally journalled in a fixed barring.

8. A weaving machine transmission in accordance with claim 7 wherein the adjusting apparatus comprises a movable connection part that is pivotally connected to the second pivotal connection point.

9. A weaving machine transmission in accordance with claim 8 wherein the adjusting apparatus comprises a gearing part that is rotatably journalled by a shaft and that is in an engagement with a worm drive, and wherein the connection part is pivotally connected, eccentrically with respect to the shaft, to the gearing part.

10. A weaving machine comprising a weaving machine transmission for the control of the stroke of a sley shaft, the weaving machine transmission comprising a roller lever and a sley shaft between which there is an active connection, wherein the roller lever and the sley shaft are arranged such that they are pivotal and mutually rotatable about a common axis, wherein a joint arrangement forms the active connection between the roller lever and the sley shaft, and wherein the length of the active connection may be varied by means of an adjusting apparatus that acts on the joint arrangement.

* * * * *